US005124001A

United States Patent [19]

Autio

[11] Patent Number: 5,124,001

[45] Date of Patent: * Jun. 23, 1992

[54] PRESS SECTION AND FRAME STRUCTURE FOR PAPER MACHINE

[75] Inventor: Markku Autio, Jyväskylä , Finland

[73] Assignee: Valmet Paper Machinery Inc., Finland

[ * ] Notice: The portion of the term of this patent subsequent to Apr. 28, 2009 has been disclaimed.

[21] Appl. No.: 470,902

[22] Filed: Jan. 26, 1990

Related U.S. Application Data

[63] Continuation of Ser. No. 181,495, Apr. 14, 1988, abandoned.

[30] Foreign Application Priority Data

Apr. 14, 1987 [FI] Finland ..... 871651

[51] Int. Cl.[5] ..... D21F 3/00

[52] U.S. Cl. ..... 162/273; 162/272; 162/274; 162/360.1; 162/358

[58] Field of Search ..... 162/272, 273, 358, 360.1, 162/274

[56] References Cited

U.S. PATENT DOCUMENTS 4,608,125 8/1986 Autio ..... 162/273

*Primary Examiner*—David A. Simmons
*Assistant Examiner*—Thi Dang
*Attorney, Agent, or Firm*—Steinberg & Raskin

[57] ABSTRACT

Press section for a paper machine and a frame construction for the same which comprises a front frame and a rear frame. Press rolls are mounted on the front and rear frames and form a press roll combination in which press fabric is passed through nips formed thereby. An at least partially open space is situated between the front and rear frames which are not directly connected to one another and above the press roll combination, through which at least most of the press rolls can be replaced. This space also facilitates replacement of upper press fabric. A suction roll is mounted in conjunction with a rear side of the front frame, while a hollow-faced press roll is mounted in conjunction with the front frame. A smooth-faced center roll of the press is mounted in conjunction with the rear frame or with a separate intermediate frame, preferably in conjunction with a projection part of the frame. This center roll forms a second nip in the press together with the hollow-faced press roll, in a running direction of a web therethrough.

44 Claims, 3 Drawing Sheets

PRESS SECTION AND FRAME STRUCTURE FOR PAPER MACHINE

This is a continuation of application Ser. No. 181,495, filed Apr. 14, 1988, now abandoned.

BACKGROUND OF THE INVENTION

The present invention concerns a press section in a paper machine and a structural frame for the same, which comprises, in a direction of running of a paper web therethrough, first a front frame and then a rear frame. Press rolls are mounted on the front and rear frames which form a press roll combination, in which press fabric or fabrics are passed through nips formed between the press rolls.

In prior art compact press sections of a paper machine, such as the Valmet so-called Sym-press (TM) press section, there are horizontal beams above the press rolls both at the servicing side and at the operating side of the paper machine, which connect the front frame and the rear frame of the press section permanently together. In this connection, and also in the following description, the front frame means the frame part that is situated in the direction of running of the web at a front side of the press roll combination, to which, e.g., a suction roll of the press is fixed. In a corresponding manner, the rear frame means the frame part situated at the rear side of the press roll combination.

Difficulties have occurred with respect to replacement both of press fabric and of press rolls in connection with the prior art frame parts of the press sections. These problems have increased with the increase in width of paper machines, in particular due to the fact that the press rolls have become increasingly longer and heavier. For example, a central roll of rock may weigh 70,000 kgs. These problems have also been increased by the fact that press fabrics which are made of plastic material and which are rigid in a transverse direction, have started being used more increasingly. Such press fabric cannot be jammed into a bundle.

Beloit Corporation has attempted to solve these problems described above by means of a so-called "Flip-Top" (trademark of Beloit Corporation) frame construction in which a top frame is used that is provided with a pivot shaft parallel to a transverse direction of the paper machine and situated above the press rolls, whereby either a top part of the front frame or a top part of the rear frame can be opened around the pivot shaft. The two top parts of the frame cannot be opened at the same time.

By opening the top part of the front frame, it is possible to facilitate replacement of the pick-up fabric of the press section and the replacement of the fabric that usually acts as the press fabric in the first nip and in the second nip. The top part of the rear frame is locked thereat as a frame part on whose support the opening-"dumping" o the top part of the front frame takes place. Correspondingly, when the top part of the front frame is in the closed-locked position, the top part of the rear frame can be "dumped" so that the press fabric of a third press nip can be replaced.

The lower fabric of the first nip, which principally runs in a basement space, is replaced by means of arrangements known in and of themselves. The above-noted "Flip-Top" solution can be characterized as a sort of "drawbridge" which is opened around an articulated joint placed expressly at a middle of the bridge, while only one half of the bridge can be opened at a time.

Frame constructions for press sections are known from the Valmet Finnish Patent Applications Nos. 844693 and 854959, in which the front frame and the rear frame are connected to each other and/or to an intermediate frame of the central roll in the press by means of various openable and closeable intermediate frames placed above. Such massive and openable/closeable intermediate frames are usable in and of themselves, but they increase the cost of manufacture of the frame section because relatively massive frame components must be provided with articulated joints and with strong means for opening and closing.

When press roll arrangements with several nips are used, problems of space are also encountered because several different press rolls with the auxiliary devices must be accommodated in a relatively limited space. This is why it has been necessary to place the frame parts that connect the front frame and the rear frame to each other or to an intermediate frame with their opening and closing means in highly congested spaces, which results in problems both in construction and in operation.

SUMMARY OF THE INVENTION

Accordingly, it is an object of the present invention to provide improvement over prior art press sections and frame structures therefor.

It is also an object of the present invention to specifically eliminate the above-noted problems.

It is another object of the present invention to provide a new and improved synergic or cooperative press section and frame structure, in which the various press rolls are fitted in a manner such that a more advantageous press construction unit is attained both in view in of the pressing process and view of the maintenance of a paper machine, which includes replacement both of press rolls and of various fabrics.

These and other objects are attained by a frame structure for a press section in a paper machine which comprises in a running direction of a paper web therethrough, a front frame and then a rear frame, with press rolls mounted on the front and rear frames forming a press roll combination in which press nips are formed between the rolls through which press fabric passes. To facilitate replacement of the press rolls and fabric, the front and rear frames are not directly connected to one another and are situated- to define an at least-partially open space situated therebetween and above the press roll combination. At least most of the press rolls in the press roll combination can be replaced through this space, which also facilitates replacement of upper press fabric situated in conjunction with the press roll combination.

Furthermore, the front frame comprises a rear side for mounting of one roll of the press roll combination thereon, and is positioned for mounting of a hollow-faced press roll thereon. The rear frame is positioned for mounting of a smooth-faced central roll forming a press nip with the hollow-faced roll, either upon the rear frame or separate from the rear frame.

The one roll of the press roll combination mounted on the front frame may preferably be a suction roll, while a separate intermediate frame for mounting of the central roll thereon may be provided. Alternatively, the rear frame may additionally comprise a projection part for mounting of the central roll thereon. The hollow-faced roll and central roll are preferably mounted to define therebetween a second nip in the running direction of the web through the machine.

Accordingly, in view of achieving the objects noted above and those which will become apparent below, a press section frame structure or construction in accordance with the present invention is principally characterized by, with a view to facilitating replacement of press rolls and press fabric, the frame construction comprising a combination of:

(a) an at least partially open space situated between the front and rear frames which are not directly to one another and above the press roll combination, through which at least most of the press rolls in the press roll combination can be replaced and which also facilitates replacement of upper press fabrics situated in conjunction therewith;

(b) a suction roll or corresponding press roll of the press roll combination, mounted in connection with a rear side of the front frame;

(c) a hollow-faced press roll mounted in connection with the front frame; and (d) a smooth-faced center roll of the press which is mounted in conjunction with the rear frame, preferably in connection with a projection part thereof, or with a separate intermediate frame, and which forms a second nip in the press together with the press roll noted above.

According to the present invention, separate front and rear frames are used which at least are not directly connected to one another by means of strong frame beams. Above the press-roll arrangement, a constantly at least partially open space remains, which is not at all closed by means of extensive frame components proper.

If necessary, the open space produced due to the present invention can be made wider by arranging those guide rolls of the upper fabrics that are situated nearest to and above the press-roll combination to be detachable as well as displaceable to an inner position in connection with the replacement of press rolls and/or upper fabrics.

According to the present invention, press concepts are provided in which a frame construction and a press-roll combination are synergically or cooperatively fitted together. In a press in accordance with the present invention, the resultant loading of a suction roll is lower than in the Valmet Sym-Press II (TM) press construction, because the suction roll is loaded by only one nip. This is why it is possible to use a suction roll which has a lower risk of damage, and possibly a suction roll that has a small diameter and mantle thickness and which is consequently of lower cost.

In a press-roll combination in accordance with the present invention, unlike the Sym-Press (TM) press, the suction roll does not form a second nip with a smooth-faced center roll of the press, but after the suction roll a pick-up felt and the web supported by the same have a substantially vertical run. This is why, e.g.,a steam box if it is used can be situated sufficiently far away from the rock roll so that it does not produce detrimental thermal effects upon the rock roll.

The suction roll is preferably journaled directly and permanently on a side of the front frame, while above the suction roll, intermediate parts, preferably angle arms, are fitted on which the hollow-faced press roll of the second nip is journalled. The intermediate parts are attached, preferably by means of an openable bolt joint or equivalent, to bearing supports of the center roll, such bearing supports being, in turn, attached to a top side of a projection part of the rear frame.

Moreover, an uppermost press roll mounted on the rear frame should preferably be supported on an articulated intermediate part which can be "dumped" in the front part of the rear frame to an inner position so that an even wider free space is opened for replacement of press rolls and/or of various fabrics.

When a frame part of a press in accordance with the present invention is applied, the front frame and the rear frame are separately dimensioned sufficiently rigid in view of various phenomena of vibration. Recently, it has been surprisingly noted that connecting of the front frame and the rear frame by means of an intermediate frame does not reduce the tendencies of vibration of the frame parts, at least not to a decisive extent.

In connection with the frame part in accordance with the present invention, it is possible to use either press fabric in the form of a closed loop, preferably plastic fabric, or so-called seamable press fabric in which case openable and closeable intermediate pieces are not necessarily required in conjunction with side frames of the frame parts, which makes the frame construction simpler and less expensive.

BRIEF DESCRIPTION OF THE DRAWINGS

The present invention will be described in further detail below with reference to certain exemplary embodiments thereof illustrated in the accompanying drawings, and to which the present invention is not intended to be strictly confined. In the drawings.

DESCRIPTION OF THE PREFERRED EMBODIMENTS

Figure 1:
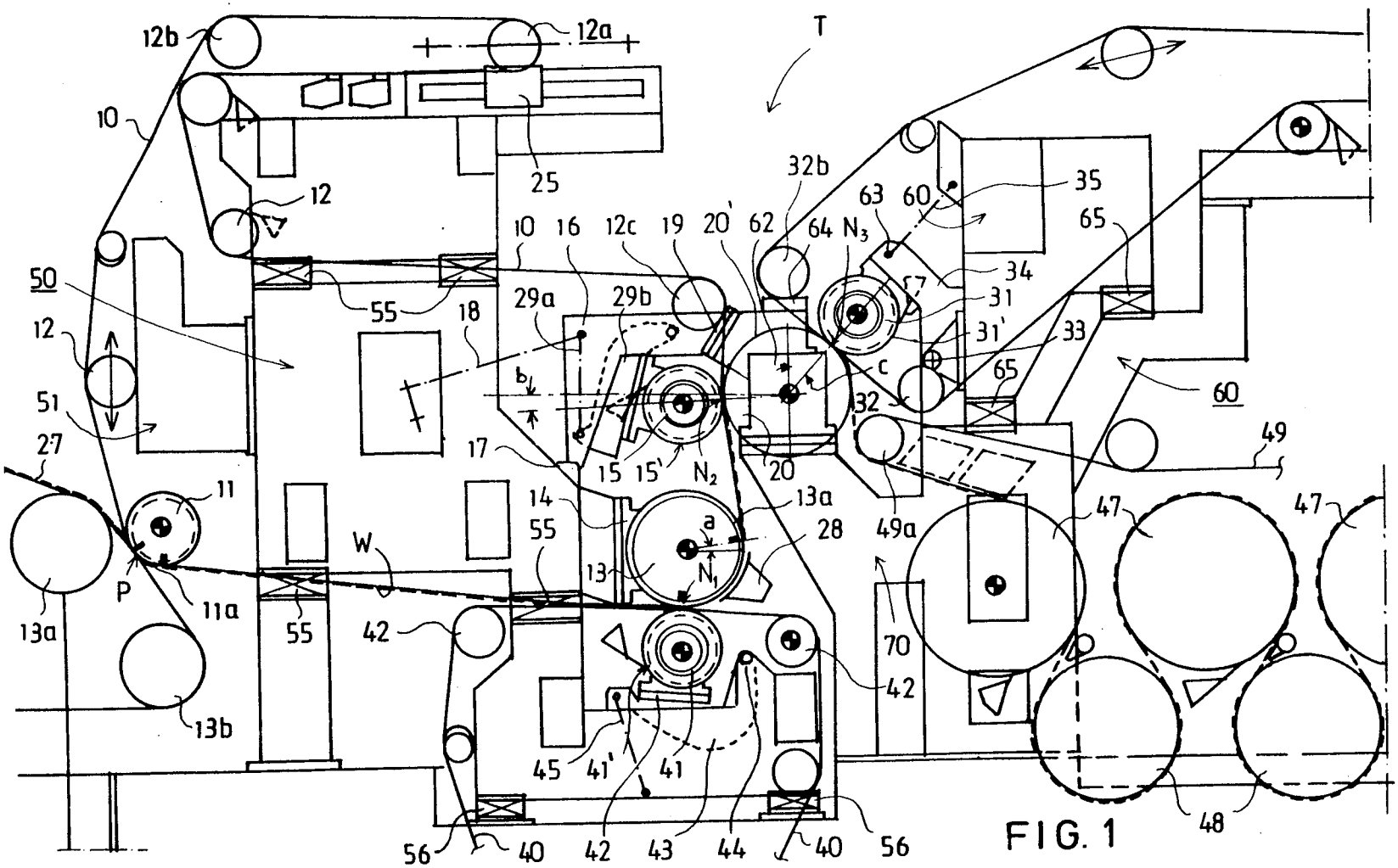
FIG. 1 is a schematic side view of a press section of a paper machine provided with a frame construction in accordance with the present invention.

A press section shown in the figures Comprises a press roll combination 41, 13, 15, 20, 31 having press rolls forming three press nips $N_1$, $N_2$ and $N_3$ which dewater a web W between the rolls. The press section includes a first upper fabric 10 and a first lower fabric 40 (as a rule, felts), both of which fabrics 10, 40 run through the first nip $N_1$. The first fabric 10 acts as a pick-up fabric and, moreover, as a press fabric in a second nip $N_2$. The second upper fabric 30 runs through the third nip $N_3$.

There is a pick-up roll 11 inside the loop of the first fabric 10 and provided with a suction zone 11*a*. The roll 11 transfers the web W from the forming wire 27 on a run between rolls 13*a* and 13*b*. The fabric 10 is guided by guide rolls 12, 12*a*, 12*b* and 12*c*. The lower fabric 40 runs as guided by guide rolls 42 and 42*a*. In a corresponding manner, the second upper fabric 30 is guided by guide rolls 32, 32*a*, 32*b*.

A lower roll 41 of the first nip $N_1$ is mounted through supports 42 on an intermediate part 43. The intermediate part 43 is attached to a front frame 50 of the press section by means of pivot shafts 44. The intermediate part 43 can be pivoted by means of hydraulic cylinders or equivalent power units 45, by which is also possible to provide loading of the $N_1$.

A suction roll 13 of the press section is mounted by means of supports 14, directly and permanently or stationarily on a rear vertical side of the front frame 50.

A press roll 15 of the second nip $N_2$ is attached to angle arms 16 which are arranged pivotable by means of horizontal articulated joint 17 in connection with a rear side of the front frame 50. The angle arms 16 or equivalent are arranged to be pivotable by means of power units 18 so as to open the nip $N_2$ and to displace the roll 15 aside, with a view to facilitating replacement of the fabric 10 and of the press rolls situated underneath. It should be noted that guide roll **12*c* of the fabric 10 is mounted on support arms 16 of the press roll 15, such arms 16 being shaped as angle arms. In this manner, the guide roll 12*c* can be displaced to an inner position 12C (FIGS. 2 and 3**) so as to facilitate replacement of the press fabric and rolls.

Figure 2:
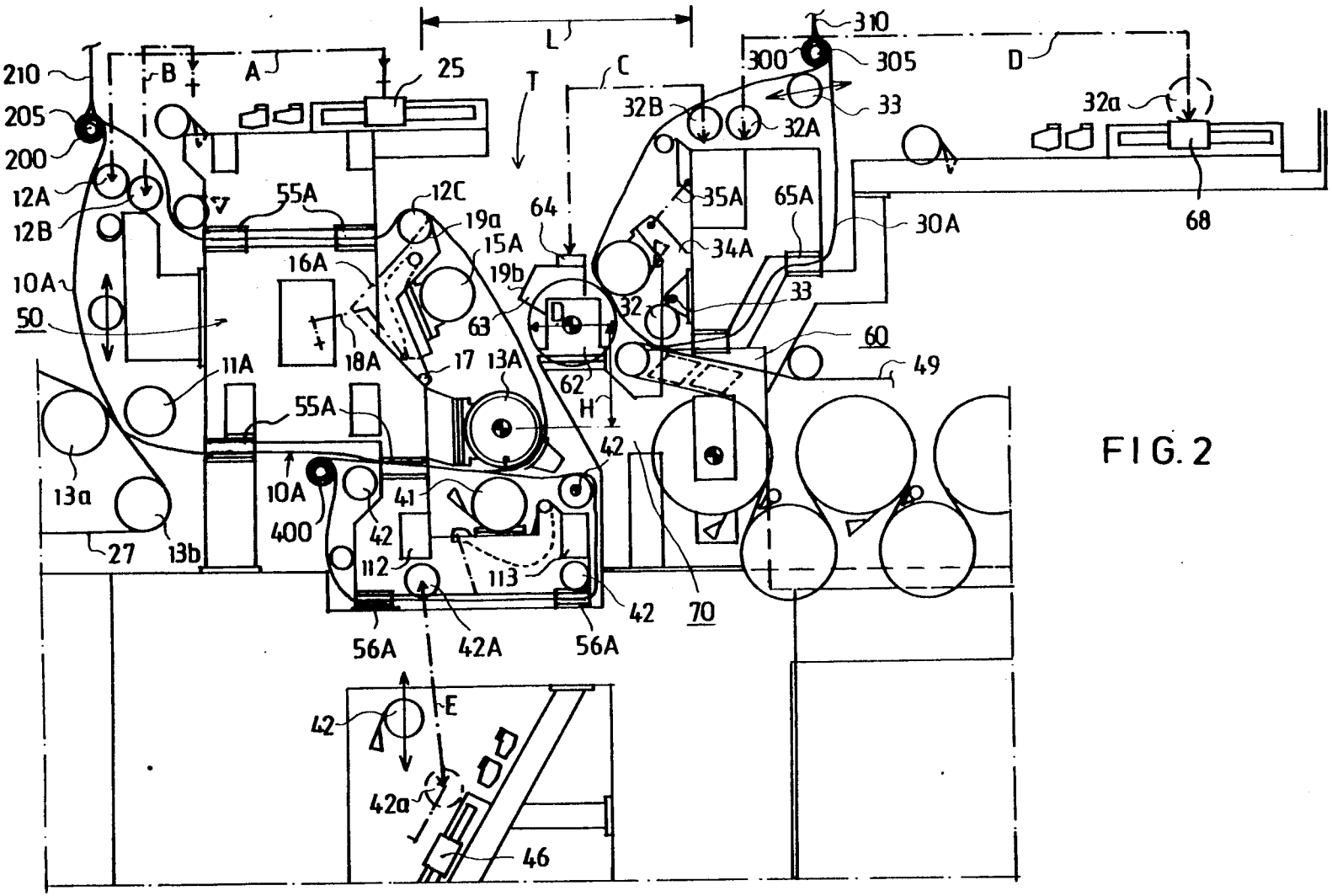
FIG. 2 illustrates replacement of various press fabric in a manner corresponding to FIG. 1.
Figure 3:
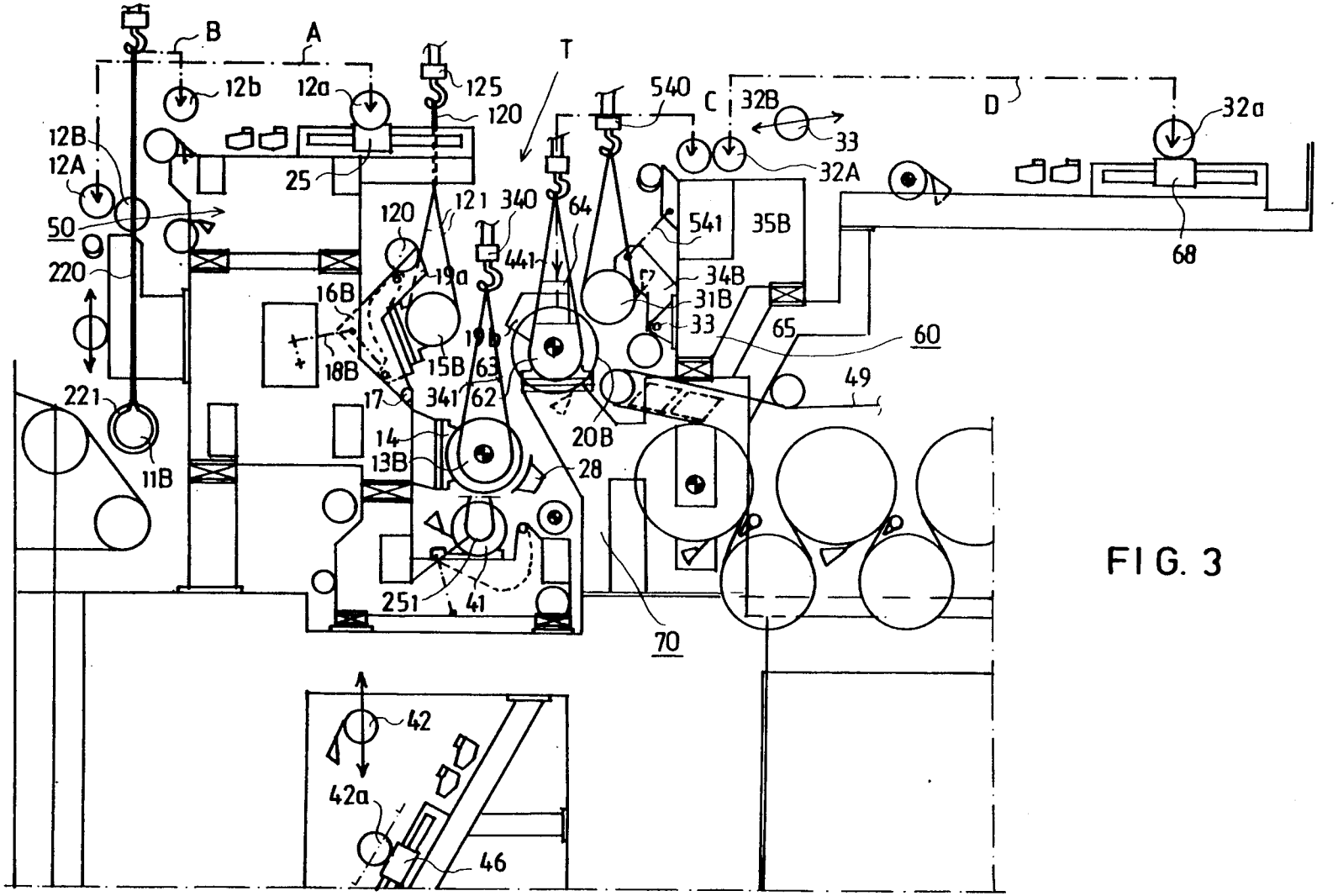
FIG. 3 illustrates replacement of various press rolls in a manner corresponding to FIGS. 1 and 2.

If necessary, axle supports of the press roll 15 can be attached to an intermediate part **29*b* which can be pivoted in connection with the angle arms 16 by means of power units 29*a* so as to load the nip $N_2$. At a side opposite to the articulation point 17, the angle arms 16 are provided with an openable fast coupling 19 by means of which the angle arms can be connected to a bearing support 62 of the center roll 20 in connection with the projection part 63. FIGS. 2 and 3 illustrate the coupling 19 as opened, so that its flange parts 19*a* and 19*b*** to be placed against one another, are situated at a distance to one another.

A hollow faced 31' press roll 31 of the third nip $N_3$ is mounted on an intermediate part 34 which is attached to a front part of the rear frame 60 by means of pivot shafts 33. The intermediate part 34 can be pivoted by means of power units 35 to an upper position so as to open the nip $N_3$ and to replace the third fabric 30. In connection with the replacement of the fabric 30, the intermediate part 34 can be locked in the open position shown in FIGS. 2 and 3.

A foremost guide roll **32*b* of the third fabric 30 is mounted on an intermediate part 64 which is also fixed in connection with an upper part of the projection part 63 of the bearing supports 62 for the center roll 20**.

Passage of a web W starting from pick-up point P is as follows. The suction sector **11*a* of the pick-up roll 11 detaches the web W from the wire 27 and makes it adhere to a lower face of the fabric 10 on which the web W passes through the two-felt nip $N_1$. The lower roll 41 of the nip $N_1$ is provided with a hollow face 41'. After the nip $N_1$, the web W follows along with the first upper fabric 10 by the effect of the suction sector 13*a* of the suction roll 13**.

After the suction roll 13, the fabric 10 and the web W supported on the same have a substantially vertical run which is directed at a small angle a rearwardly. The angle a is, as a rule, within the range of a=about 15°-30°. The second nip $N_2$ is formed between a hollow-faced 15' press roll 15 and a smooth-faced 20' center roll 20. The nip $N_2$ is situated by a small angle b below a horizontal plane passing through a central axis of the center roll 20, with this angle b being, as a rule, b=about 0°-10°. A length of this substantially vertical run is preferably somewhat longer than a diameter D of the center roll 20, and preferably so that, in the direction of running of the web, the center roll 20 is situated approximately by the measure of its diameter D after the preceding suction roll 13.

In the second nip $N_2$, the web W is transferred onto the face of the smooth-faced 20' center roll, e.g. a rock roll 20, and further into the third nip $N_3$ whereupon the web W follows along with the center roll 20 and, being guided by guide roll **49*a* of a drying wire, is transferred onto a single-draw fabric 49 in the drying section. The web W is transferred as a single-fabric draw to the drying section, in which three upper cylinders 47 and two lower cylinders 48 or leading rolls are illustrated in this figure. The nip $N_3$ is situated by an angle c after a vertical center plane of the roll 20**, this angle c being, as a rule, c=about 30°-60°.

Linear loads prevailing in the nips $N_1$, $N_2$, $N_3$ are preferably as follows:

$N_1$, 80±10 kN/m, roll pair suction/hollow-faced,
$N_2$, 90±10 kN/m, roll pair hollow-faced/smooth,
$N_3$, 140±10 kN/m, roll pair hollow-faced/smooth.

According to the figures, a steam box 28 is provided in connection with the suction roll 13. This steam box 28 can be situated far enough from the center roll 20 so that the steam box 28 does not produce detrimental thermal effects on the rock material of the center roll.

An important factor in a press section in accordance with the present invention is the difference H in height between center axes of the suction roll 13 and the center roll 20, this difference in height being, as a rule, on the order of H=about 1-2.5 m. In this fashion, sufficiently ample room is provided in the press-roll combination so that several different components can be situated and supported in the different frame parts 50, 60, 70 unhindered by each other, whereby replacement of the press fabrics and rolls is also facilitated.

The press section frame construction in accordance with the present invention comprises a front frame 50 and a separate rear frame 60. The front frame 50 and the rear frame 60 are separate in such a manner that they are separated by a space T opened at the top. This space T can be utilized in accordance with the present invention in replacement of the press rolls. This open space T also facilitates replacement of upper fabrics 10 and 30. The invention is also suitable for application in presses in which there are three nips in connection with the center roll 20.

The separate frame parts 50 and 60 in accordance with the present invention are designed so that, even when separate, they are sufficiently rigid, e.g., in view of various vibration phenomena.

The rear frame 60 in accordance with the present invention includes a projection part 70, on which the center roll 20 of the press is supported and journaled from below. The projection part 70 may also be separate from the front frame 50 and from the rear frame 60, yet arranged in a manner such that the lower fabric 40 can be replaced.

The accompanying figures show an embodiment of the invention in which the suction roll 13 is permanently or stationarily mounted on a rear side of the front frame 50. However, the present invention may also be accomplished in a manner such that the suction roll 13 and the press roll 15 situated above the suction roll are attached to a common intermediate frame, e.g. angle arms, which are connected to a rear part of the front frame 50 by means of horizontal articulated joints at a level of the suction roll 13, preferably from below its center plane. The intermediate frame is arranged to be pivotable by means of power units. The press roll 15 can be attached to the intermediate frame either directly or through an additional intermediate frame and power units. The upper part of the intermediate frame noted above is preferably attached by means of a joint or coupling 19 in connection with bearing supports of the center roll 20.

In FIG. 2, length of the open space T between the front frame 50 and the rear frame 60 in the machine direction is denoted by L. This length L can be optimized, e.g., so that if the length L is set in proportion, e.g., to the diameter D of the largest press roll, i.e. the center roll 20, which diameter D is of the order of D roughly equal to about 1000 to 1800 mm, L=kD, wherein advantageously k=about 2.5 to 4.0, preferably k=about 3.0 to 3.2.

Replacement of the various fabrics 10, 30, 40 in connection with the frame construction of the present invention, will be described below with reference to FIG. 2.

When the upper fabric 10 is being replaced, the old fabric is removed and the intermediate pieces 55 in a lateral part of the front frame 50 at the service side are opened, so that free intermediate spaces 55A are opened at the service side of the front frame 50. The front frame pick-up roll 11 is displaced to the open position 11A. The press roll 15 situated inside the fabric loop 10 is displaced to the position 15A which opens the nip $N_2$ by pivoting the angle arms 16 by means of the power units 1B. The nip $N_1$ is opened by using the power units 45. In order that all the rolls to be placed inside the loop of the fabric 10 can be situated sufficiently close to one another, the upper guide roll **12*a* situated as supported on tensioning devices 25 is displaced along route A to its parking site at position 12A. By the same token, the other guide roll 12*b* situated above the front frame 50 is displaced to its parking site situated on projection part 51 of the front frame 50, at a lower position 12B**.

When the pick-up point P and the nips $N_1$ and $N_2$ are opened, when the rolls **12*a* and 12*b* are in lower positions 12A and 12B, and when the intermediate pieces 55 are opened, the new fabric loop is passed through intermediate spaces 55A in the servicing side of the frame to form a loop 10A as shown in FIG. 2, opened from fabric roll 200 which is situated on replacement pole 205. The replacement pole 205 is supported from both ends by means of lifting wires 210 which are fixed to a traverse crane (not illustrated) in the paper machine hall. Thereupon, the loop 10A is spread out by unwinding the fabric 10 from the twofold roll 200 to its full width and length while, at the same time, displacing the guide rolls 12A and 12B to their normal operating positions along routes A and B. After the fabric 10 has been spread out and tensioned, the pick-up point P and the nips $N_1$ and $N_2$ are closed, and the intermediate pieces 55 and the fabric 10** are tightened.

When the lower fabric 40 is being replaced, the guide roll **42*a* which is situated in a sublevel or basement space and supported on tensioning means 46 is displaced along route E to an upper position 42A, a lowest one of the intermediate pieces 55 as well as intermediate pieces 56 are opened, and fabric loop 40A is passed from roll 400 around beams 112, 113, the press roll 41 and the guide rolls 42, whereupon the intermediate pieces 115 are closed, the roll 42A is displaced into the basement or sublevel space, and the fabric 40 is tensioned by means of devices 46**.

The second upper fabric 30 is replaced so that the old fabric is removed, the intermediate pieces 65 are opened, and the foremost guide roll **32*b* is displaced along route C to its parking site at an inner position 32B. Correspondingly, a rearmost guide roll 32*a* is displaced along route D to its parking site alongside the roll 32B to position 32A. The nip $N_3$ is opened by displacing roll 31 to the upper 31A by pivoting the intermediate part 34 to the position 34A by means of the power units 35B. Fabric roll 300 supported by replacement pole 305 and by lifting wire 310, and having been spread out into a loop 30A, is passed around the press roll 31 and the guide rolls 32, 32A and 32B through intermediate spaces 65A, whereupon the rolls 32A and 32B are displaced along routes C and D to their operating positions while at the same time unwinding the fabric 30A from the roll 300 and spreading the fabric. Then, the nip $N_3$ is closed and the fabric 30 is tensioned by mean of tensioning devices 68 of guide roll 32*b***.

The side frames at the servicing edge of the front frame 50 and the rear frame 60 may be provided with intermediate pieces 55, 56, 65, which are opened in connection with the replacement of a closed press fabric loop 10, 30, 40. Within the scope of the present invention, it is also possible to use seamable press and transfer fabrics. In such a case, the openable intermediate pieces 55, 56 and 65 are not needed in the frame parts. In other words, the side frames of the front and rear frame may be fully closed and nonopenable, when the seamable press fabrics are used as the press fabrics in the press section.

Replacement of the pick-up roll 11 and of the different press rolls will be described below with reference to FIG. 3. When the pick-up roll 11 is being replaced, it is in the position 11B and the fabric 20 has been removed. Loops 221 of pairs of lifting wires 220 are attached to axle journals of the pick-up roll 11B. The lifting wires 220 are attached to the traverse crane in the paper machine hall.

The hollow-faced press roll 15 of the second nip $N_2$ is replaced by pivoting the angle part 16 by means of the power units 18B to an open position 16B, whereby the guide roll **12*c* of the fabric 10 is also displaced to the inner position 12C. In this manner, a relatively large space is opened between the center roll 20 and the press roll 15B. The axle journals of the press roll 15B are attached to the lifting loops 121 of the lifting wire 120, and the lifting is carried out by means of the lifting hooks 125** of the traverse crane.

The upper roll 13B of the first nip $N_1$ is replaced after removal of the roll 15 by making use of the open space T between the frame parts 50 and 60. The roll 13 (suction roll) may also be replaced by means of lengthwise pulling, without removing the roll 15. After the fabric loop 20 has been removed, the roll 13B is suspended on loop 341 of hook 340, detached from its bearing supports 14, and lifted by means of a traverse crane above the press section while making use of the space T.

The lower roll 41 of the first nip $N_1$ is replaced after removal of the rolls 13 and 15 by making use of the space T so that the roll 41 is detached from its bearing supports and supported by means of its axle journals on wire loops 251. The roll 41 is then removed, either by lifting upwardly by means of the lifting wires, or by lengthwise pulling along the pulling-out beam situated underneath the roll.

The center roll 20 is replaced by lifting while suspended on lifting loops 441 of lifting hook 440, and by making use of the space T. The upper roll 31B of the third nip $N_3$ is replaced by lifting of wire loops 541 of lifting hook 540 and by making use of space T.

In FIG. 2, reference numeral 16A refers to the open position of arm 16 illustrated in FIG. 1, with reference numeral 25A referring to the retracted position of the power unit 35 denoted in FIG. 1, and reference numeral 56A referring to an intermediate space left open by the intermediate pieces 56 illustrated in FIG. 1. Reference numeral 18A in FIG. 2 refers to the retracted position of the power unit 18 of FIG. 1. In FIG. 3, reference numeral 20B refers to the roll 20 that is about to be lifted with lifting loops 441, with reference numeral 34B referring to the retracted position of intermediate part 34.

Instead of supporting by the axle journals which has been described above, the press rolls, at least the heaviest rolls, can also be lifted by so-called center lifting, in which the lifting takes place by means of one lifting wire which is situated at a vertical plane of a center of gravity of the roll to be lifted, with lifting loops arranged in the form of a downwardly open V being provided around the roll at both sides of this plane. The center lifting provides the advantage that, by this means, the roll can be turned more freely above the frame construction of the press section to the machine direction, whereby displacement of the roll becomes easier. The new rolls can be brought to their place correspondingly.

The new rolls are situated in their location by performing the operations described above in the reversed sequence.

The same reference numerals denote the same or similar components throughout the various figures.

Various details of the present invention may vary within the inventive concepts set forth above, which are given for exemplary purposes only. Therefore, the preceding description of the present invention is merely exemplary, and is not intended to limit the scope thereof in any way.

What is claimed is:

1. Frame structure for a press section in a paper machine which comprises in a running direction of a paper web therethrough, a front frame and then a rear frame, with press rolls mounted on said front and rear frames forming a press roll combination in which press nips are formed between the rolls through which press fabric passes, wherein to facilitate replacement of press rolls and fabric, said front and rear frames are separate from one another and are situated to define an open space situated therebetween and above the press roll combination, through which at least most of the press rolls in the press roll combination can be replaced and which also facilitates replacement of upper press fabrics situated in conjunction with the press roll combination, said front and rear frames being permanently unconnected during all operational phases by any intermediate frame structure, said press roll combination comprises a smooth faced center roll, a first hollow-faced press roll mounted in an openable manner on a first frame part forming a first press nip with said center roll, and a second hollow-faced press roll mounted in a openable manner on a second frame part forming a second press nip with said center roll, said first frame part being articulated at an inner end region to said front frame, said second frame part being articulated to said rear frame, and at least one of said first and second frame parts being supported at an outer end region thereof.

2. The structure of claim 1, additionally comprising a separate intermediate frame for mounting of the central roll thereon.

3. The structure of claim 1, wherein said rear frame additionally comprises a projection part for mounting of the central roll thereon.

4. The structure of claim 1, additionally comprising a guide roll for a fabric passing through said second press nip in the running direction and a stationary support for supporting said guide roll.

5. The structure of claim 4, additionally comprising an intermediate frame with said stationary support attached to an upper part thereof.

6. The structure of claim 4, further comprising a bearing support for the central roll said stationary support being attached to said bearing support.

7. The structure of claim 4, wherein said rear frame comprises a parking site for the guide roll which is detachably mounted, and a path for displacement of the guide roll to said parking site is provided through said open space when the fabric or a press roll of said press roll combination has to be replaced.

8. The structure of claim 1, wherein the central roll is mounted with a center of rotation thereof situated substantially at a middle of said open space over the running direction.

9. The structure of claim 1, additionally comprising intermediate pieces mounted a sides of said front and rear frames for servicing, to be openable when replacing a closed press fabric loop.

10. The structure of claim 1, wherein lateral sides of said front and rear frames are closed and nonopenable when seamable press fabrics are used in the press section.

11. The structure of claim 1, wherein at least three press fabrics are used, a first one of which acts as a pick-up fabric as well as an upper press fabric in said first press nip in the running direction, guide rolls for the first upper fabric are displaceably mounted on said front frame, a first lower fabric is arranged with at least one guide roll therefor located at a sublevel position below the press section, and a second fabric is arranged to pass through a third nip in the running direction, with guide rolls therefor being journalled in said rear frame.

12. The structure of claim 11, wherein said front frame comprises a parking site for at least one of the guide rolls for the first upper fabric, the at least one guide roll for the first lower fabric is arranged to be displaceable to an upper position for replacement of the first lower fabric, and said rear frame comprises at least one parking site for at least one of the guide rolls for the second upper fabric.

13. The structure of claim 1, wherein size of said space in a running direction of the web is proportional to diameter (D) of a largest press roll of said press roll combination.

14. The structure of claim 13, wherein $L=kD$ wherein $k=$about 2.5 to 4.0.

15. The structure of claim 14, wherein $k=$about 3.0 to 3.2.

16. The structure of claim 1, wherein said first press nip is situated at an angle of about 0° to 10° below a substantially horizontal plane extending through a center axis of the central roll.

17. The structure of claim 1, wherein said second press; nip is situated by an angle of about 30° to 60° with a substantially vertical plane passing through a center of rotation of the central roll.

18. Press section of a paper machine and a frame construction for the same which comprises, in a running direction of a paper web, first a front frame and then a rear frame, with press rolls mounted on said front and rear frames forming a press roll combination, in which press nips are formed between said press rolls, press fabrics being passed through said press nips, said press section comprising an openable space situated between said front and rear frames, said front and rear frames being permanently unconnected to each other by any intermediate frame structure during all operational phases, and above said press roll combination, through which space at least most of the press rolls of said press rolls combination can be replaced, and which space also facilitates replacement of the upper press fabrics situated in conjunction therewith, said frame construction further comprising, with to facilitating replacement of press rolls and press fabrics, a combination of (a) a first roll of said press roll combination, mounted in conjunction with a rear side of said front frame;

(b) a second roll of said press roll combination, said second roll forming a first one of said press nips in combination with said first roll;

(c) a hollow-faced press roll mounted in conjunction with said front frame in an openable manner; and (d) a smooth-faced center roll of the press section mounted in an openable manner in conjunction with the rear frame, or in conjunction with a separate intermediate frame, said center roll forming a second one of said press nips of the press section together with said hollow-faced press roll and said center roll being spaced apart from said first roll so as to be incapable of forming a press nip therewith.

19. The press section of claim 18, additionally comprising a separate intermediate frame for mounting of the center roll thereon.

20. The press section of claim 18, wherein said rear frame additionally comprises a projection part for mounting of the center roll thereon.

21. The press section of claim 18 wherein said rear frame additionally comprises an intermediate part fitted thereon for supporting a hollow-faced press roll of said press roll combination mounted thereon to define with the center roll, a third nip in the running direction.

22. The press section of claim 18, wherein said first roll is a suction roll and additionally comprising at least one angle arm on which at least one of the suction roll and hollow-faced press roll is mounted and which is linked to said rear side of said front frame arranged at an articulation point thereof, and an openable fast coupling at an end of said at least one angle arm opposite said articulation point for connecting said arm to a bearing support for the center or to a projection part attached to the bearing support.

23. The press section of claim 22, wherein a guide roll for supporting an upper fabric passing along an upper edge of a first nip with respect to the running direction of the web is also mounted on said angle arm.

24. The press section of claim 18, additionally comprising a stationary support for supporting a guide roll for a fabric passing through a third nip in the running direction.

25. The press section of claim 24, additionally comprising an intermediate frame with said stationary support attached to an upper part thereof.

26. The press section of claim 24, wherein said stationary support is attached to a bearing support for the center roll.

27. The press section of claim 24 wherein said rear frame comprises a parking site for the guide roll which is detachably mounted, and a path for displacement of the guide roll to said parking site is provided through said open space when the fabric or a press roll of said press roll combination has to be replaced.

28. The press section of claim 24, wherein the center roll is mounted with a center of rotation thereof situated substantially at a middle of said open space over the running direction.

29. The press section of claim 24, additionally comprising intermediate pieces mounted at sides of said front and rear frames for servicing, to be openable when replacing a closed press fabric loop.

30. The press section of claim 24, wherein said lateral sides of said front and rear frames are closed and nonopenable when seamable press fabrics are used in the press section.

31. The press section of claim 18, wherein at least three press fabrics are used, a first one of which acts as a pick-up fabric as well as an upper press fabric in first and second nips in the running direction, guide rolls for the first upper fabric are displaceably mounted on said front frame, a first lower fabric is arranged to pass through the first nip with at least one guide roll therefor located at a sublevel position below the press section, and a second upper fabric is arranged to pass through a third nip in the running direction, with guide rolls therefor being journalled in said rear frame.

32. The press section of claim 31, wherein said front frame comprises a parking site for at least one of the guide rolls for the first upper fabric, the at least one guide roll for the first lower fabric is arranged to be displaceable to an upper position for replacement of the first lower fabric, and said rear frame comprises at least one parking site for at least one of the guide rolls for the second upper fabric.

33. The press section of claim 18, wherein said first roll is a suction roll and the center roll is fixedly journalled at a higher level than the suction roll, with both the center roll and the suction roll being fitted to conduct the web as a substantially vertical run from the suction roll to the central roll.

34. The press section of claim 33, wherein length of the substantially vertical run is larger than the diameter of the center roll.

35. The press section of claim 33, wherein length of the substantially vertical run is substantially equal to the diameter of the center roll.

36. The press section of claim 33, wherein substantially vertical distance between center axes of the suction and center rolls is about 1 to 2.5 mm.

37. The press section of claim 18, wherein size L of said space in running direction of the web is proportional to diameter of a largest press roll of said press roll combination.

38. The press section of claim 37, wherein $L=kK$ wherein $k=$about 2.5 to 4.0.

39. The press section of claim 38, wherein $k=$about 3.0 to 3.2.

40. The press section of claim 18, wherein said first roll is a suction roll and the center roll and suction roll are fitted to conduct the web from the suction roll to the central roll at a rearward angle of about 15° to 30°.

41. The press section of claim 28, wherein the second nip is situated at an angle of about 0° to 10° below a substantially horizontal plane extending through a center axis of the center roll.

42. The press section of claim 21, wherein the third nip is situated by an angle of about 30° to 60° after a substantially vertical plane passing through a center of rotation of the center roll.

43. The press section of claim 18, wherein the first roll is a press roll.

44. The press section of claim 18, wherein the center roll is mounted in conjunction with a projection part of said rear frame.

* * * * *